US006338323B1

(12) United States Patent
Machida

(10) Patent No.: US 6,338,323 B1
(45) Date of Patent: Jan. 15, 2002

(54) VANE TYPE VARIABLE VALVE TIMING CONTROL APPARATUS AND CONTROL METHOD

(75) Inventor: Kenichi Machida, Atsugi (JP)

(73) Assignee: Unisia Jecs Corporation, Kanagawa-Ken (JP)

( * ) Notice: Subject to any disclaimer, the term of this patent is extended or adjusted under 35 U.S.C. 154(b) by 0 days.

(21) Appl. No.: 09/669,567

(22) Filed: Sep. 26, 2000

(30) Foreign Application Priority Data

Sep. 28, 1999 (JP) ..... 11-273897

(51) Int. Cl.[7] ..... F01L 1/34

(52) U.S. Cl. ..... 123/90.17; 123/90.15; 123/90.31

(58) Field of Search ..... 123/90.17, 90.15, 123/90.16, 90.18, 90.31, 90.12, 90.34, 90.38; 74/567

(56) References Cited

U.S. PATENT DOCUMENTS 5,836,277 A * 11/1998 Kira et al. ..... 123/90.17
6,006,708 A * 12/1999 Ken et al. ..... 123/90.17
6,129,060 A * 10/2000 Koda ..... 123/90.17
6,129,062 A * 10/2000 Koda ..... 123/90.17
6,135,077 A * 10/2000 Moriya et al. ..... 123/90.17
6,186,104 B1 * 2/2001 Torii et al. ..... 123/90.17
6,202,610 B1 * 3/2001 Yoshiki et al. ..... 123/90.15
6,216,655 B1 * 4/2001 Yoshiki et al. ..... 123/90.15
6,230,675 B1 * 5/2001 Kobayashi et al. ..... 123/90.15
6,260,526 B1 * 7/2001 Kobayashi ..... 123/90.17

FOREIGN PATENT DOCUMENTS

JP 10-68306 3/1998
JP 10-141022 5/1998

* cited by examiner

*Primary Examiner*—Teresa Walberg
*Assistant Examiner*—Fadi H. Dahbour
(74) *Attorney, Agent, or Firm*—Sughrue Mion, PLLC

(57) ABSTRACT

In a vane type variable valve timing control apparatus, a neutral control value for retaining a rotation phase of a cam shaft is set in accordance with a target rotation phase, and the supply and discharge of oil to respective hydraulic chambers is performed at a balance corresponding to a change in an urging force of a resilient body for urging the vane.

9 Claims, 4 Drawing Sheets

VANE TYPE VARIABLE VALVE TIMING CONTROL APPARATUS AND CONTROL METHOD

BACKGROUND OF THE INVENTION (1) Field of the Invention

The present invention relates to a vane type variable valve timing control apparatus and control method for changing valve timing of an internal combustion engine.

(2) Related Art of the Invention

As a vane type variable valve timing control apparatus, there is one heretofore disclosed in Japanese Unexamined Patent Publication Nos. 10-141022 and 10-068306.

With this apparatus, recess portions are formed on an inner peripheral face of a cylindrical housing secured to a cam sprocket, while vanes secured to a cam shaft are accommodated in the recess portions, the construction being such that the cam shaft can rotate relatively with respect to the cam sprocket, within a range in which the vanes can move inside the recess portions.

Furthermore, the construction is such that by supplying and discharging oil by means of a spool valve, relatively with respect to a pair of hydraulic chambers (advance angle side hydraulic chamber and delay angle side hydraulic chamber) formed by the vanes partitioning the recess portions into front and rear in the rotation direction, the position of the vanes in the recess portions is changed, thereby enabling a rotation phase of the cam shaft relative to a crank shaft to be continuously changed.

A control value of the spool valve is determined by adding a feedback correction value set depending on a deviation of an actual rotation phase from a target value, to a neutral control value for retaining a rotation phase. A dither signal is then superimposed on the determined control value which is then output to an actuator of the spool valve.

However, as disclosed in Japanese Unexamined Patent Publication No. 10068306, in the case where a resilient body such as a spiral spring for urging the vane to the advance angle side or to the delay angle side is provided, then with a conventional construction in which the neutral control value is constant regardless of a target rotation phase, there is a problem in that the pressure balance cannot be maintained, and a steady-state deviation occurs.

That is to say, with a construction having a resilient body for urging the vane, the urging force of the resilient body varies due to the rotation phase. Therefore, when the valve is driven about the valve position corresponding to the neutral control value, using a constant neutral control value regardless of the rotation phase, the rotation phase is shifted to the advance angle side or to the delay angle side, depending on whether the neutral control value is higher or lower than a suitable urging force. When the rotation phase is shifted from a target, it is then corrected by feedback correction. However, time is required for convergence, and since the correction value requirement differs for each rotation phase, convergence is not possible, causing a problem due to the occurrence of steady-state deviation.

SUMMARY OF THE INVENTION

In view of the above problems it is an object of the present invention, with a vane type variable valve timing control apparatus comprising a resilient body for urging a vane to an advance angle side or to a delay angle side with respect to a cam sprocket, to enable a target rotation phase to be precisely maintained without causing a steady-state deviation.

To achieve the above object, the present invention is constructed such that a neutral control value of a spool valve is set in accordance with a target rotation phase.

With such a construction, a reference position of the valve at the time of retaining the rotation phase is set in accordance with a target value of the rotation phase, to thereby cause the valve to be driven about the valve position corresponding to the target value. As a result, it is possible to supply and discharge oil to each hydraulic chamber at a balance corresponding to the urging force of the resilient body, enabling suppression of the occurrence of steady-state deviation.

Here, the neutral control value of the spool valve is preferably changed according to the oil pressure, as well as being changed according to the target rotation phase.

With such a construction, there is the effect that it is possible to correspond to differences in requirements of the neutral control value due to changes in the oil pressure, and that the occurrence of steady-state deviation due to changes in the oil pressure can be avoided.

Moreover, in the case of a construction where an oil pump for supplying oil to the spool valve is driven by an engine, the rotation speed of the pump is proportional to the rotation speed of the engine, and the oil pressure can be estimated from the rotation speed of the engine. Hence the rotation speed of the engine can be used as a parameter corresponding to the oil pressure.

Furthermore, it is preferable to correct the neutral control value in accordance with the oil temperature.

With such a construction, the neutral control value set in accordance with the target rotation phase is corrected in accordance with the oil temperature, that is, the viscosity of the hydraulic fluid, giving an effect that the occurrence of steady-state deviation due to a change in the oil temperature can be avoided.

Other objects and aspects of the present invention will become apparent from the following description of embodiment given in conjunction with the appended drawings.

DESCRIPTION OF THE PREFERRED EMBODIMENT

Figure 1:
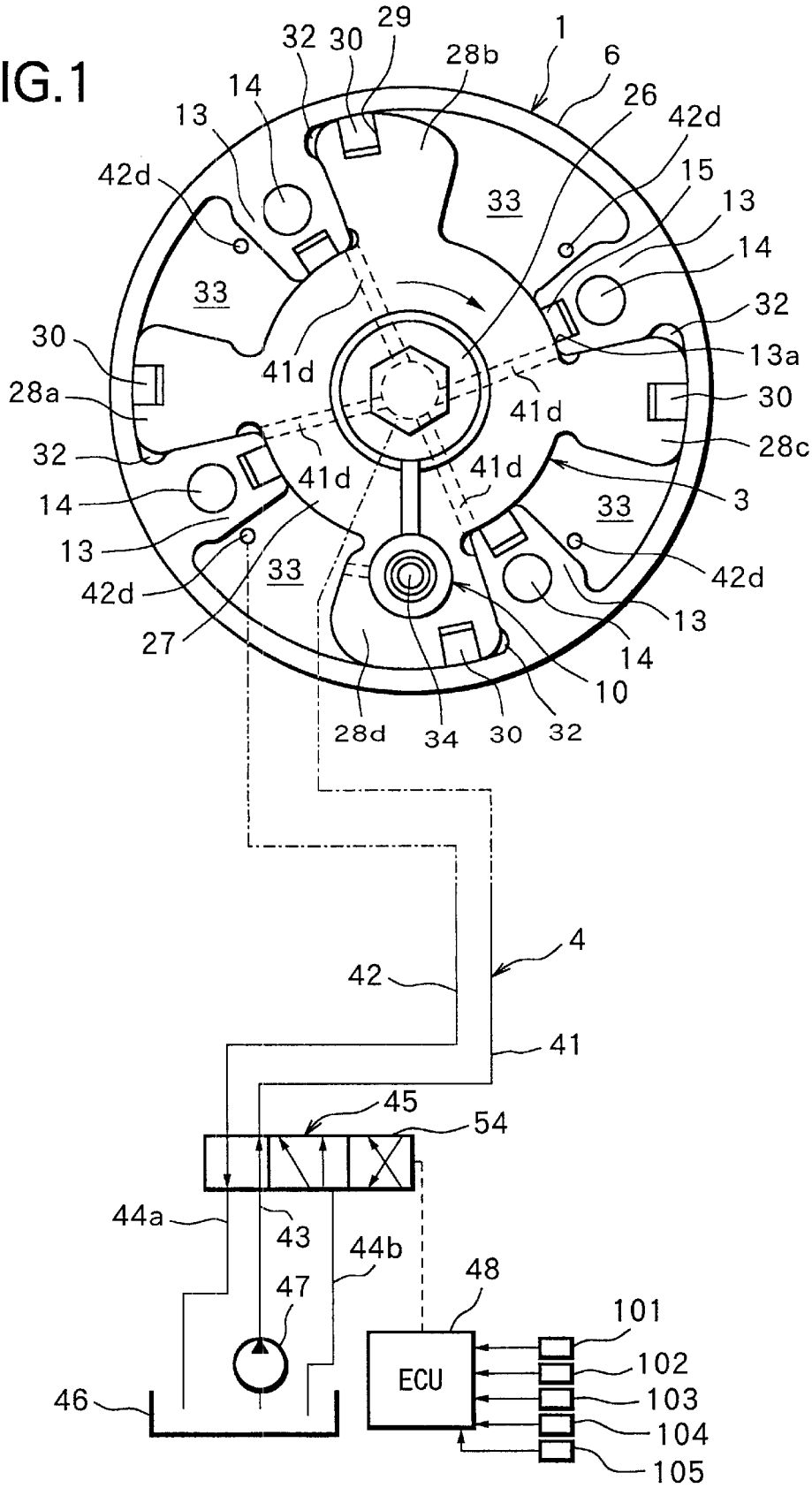
FIG. 1 is a sectional view showing a structural portion of a vane type variable valve timing control apparatus in one embodiment.

FIG. 1 shows a structural portion of a vane type variable valve timing control apparatus of an internal combustion engine, in an embodiment. In an engine comprising both a cam shaft on the intake side and a cam shaft on the exhaust side, this apparatus is applied to the cam shaft on the intake valve side, to variably control the valve timing of an intake valve.

The vane type variable valve timing control apparatus shown in FIG. 1 comprises: a cam sprocket 1 which is rotatably driven by an engine crank shaft (not shown in the figure) via a timing chain; a rotation member 3 secured to an end portion of a cam shaft and rotatably housed inside the cam sprocket 1; a hydraulic circuit 4 for relatively rotating the rotation member 3 with respect to the cam sprocket 1; and a lock mechanism 10 for selectively locking a relative rotation position between the cam sprocket 1 and the rotation member 3 at a predetermined position.

The cam sprocket 1 comprises: a rotation portion (not shown) having on an outer periphery thereof, teeth for engaging with a timing chain (or timing belt); a housing 6 located forward of the rotation portion, for rotatably housing the rotation member 3; and a front cover and a rear cover (both not shown) for closing the front and rear openings of the housing 6.

Furthermore, the housing 6 presents a cylindrical shape formed with both front and rear ends open and with four partition portions 13 protrudingly provided at positions on the inner peripheral face at 90° in the circumferential direction.

The partition portions 13 present a trapezoidal shape in transverse section, and are respectively provided along the axial direction of the housing 6. Each of the opposite end edges are in the same plane as the opposite end edges of the housing 6, and on the base edge side are formed four bolt through holes 14 in the axial direction, through which bolts are inserted for axially and integrally coupling the rotation portion, the housing 6, the front cover and the rear cover.

Moreover, inside of retention grooves 13*a* formed as cut-outs along the axial direction in central locations on the inner edge faces of each partition 13 are engagingly retained seal members 15.

The rotation member 3 is secured to the front end portion of the cam shaft by means of a fixing bolt 26, and comprises an annular base portion 27 having, in a central portion, a bolt hole through which the fixing bolt 26 is inserted, and four vanes 28*a*, 28*b*, 28*c*, and 28*d* integrally provided on an outer peripheral face of the base portion 27 at 90° locations in the circumferential direction.

The first through fourth vanes 28*a* to 28*d* present respective cross-sections of approximate trapezoidal shapes. The vanes are disposed in the recess portions between each partition portion 13 so as to form spaces in the recess portions to the front and rear in the rotation direction. Advance angle side hydraulic chambers 32 and delay angle side hydraulic chambers 33 are thus formed between the opposite sides of the vanes 28*a* to 28*d* and the opposite side faces of the respective partition portions 13.

Inside of respective retention grooves 29 notched axially in the center of the outer peripheral faces of the respective vanes 28*a* to 28*d* are engagingly retained seal members 30 for rubbing contact with inner peripheral faces of the housing 6.

The lock mechanism 10 has a construction such that a lock pin 34 is inserted into an engagement hole (not shown) at a rotation position on the maximum delay angle side of the rotation member 3.

Figure 2:
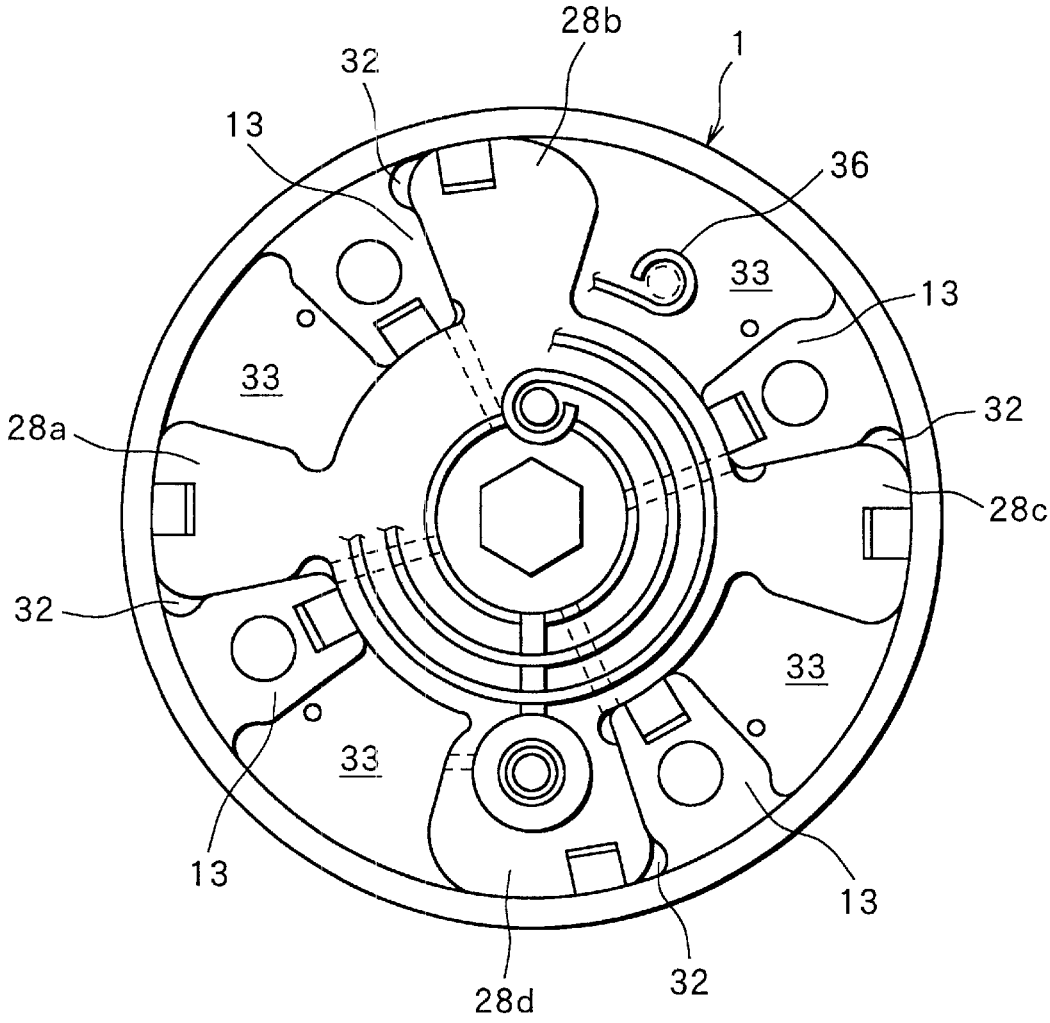
FIG. 2 is a sectional view showing a vane urging mechanism in the vane type variable valve timing control apparatus.

Moreover, as shown in FIG. 2, the rotation member 3 (vanes 28*a* to 28*d*) has a construction such that one end thereof is secured to the front cover, and the other end is urged to the delay angle side by a spiral spring 36 serving as a resilient body, secured to the base 27 by a pin.

As the resilient body for urging the rotation member 3 (vanes 28*a* to 28*d*), an extension/compression coil spring, a torsion coil spring, a plate spring or the like may be used instead of the spiral spring 36.

The hydraulic circuit 4 has a dual system oil pressure passage, namely a first oil pressure passage 41 for supplying and discharging oil pressure with respect to the advance angle side hydraulic chambers 32, and a second oil pressure passage 42 for supplying and discharging oil pressure with respect to the delay angle side hydraulic chambers 33. To these two oil pressure passages 41 and 42 are connected a supply passage 43 and drain passages 44*a* and 44*b*, respectively, via an electromagnetic switching valve 45 for switching the passages.

An engine driven oil pump 47 for pumping oil inside an oil pan 46 is provided in the supply passage 43, and the downstream ends of the drain passages 44*a* and 44*b* are communicated with the oil pan 46.

The first oil pressure passage 41 is formed substantially radially in the base 27 of the rotation member 3, and connected to four branching paths 41*d* communicating with each hydraulic chamber 32 on the advance angle side. The second oil pressure passage 42 is connected to four oil galleries 42*d* opening to each hydraulic chamber 33 on the delay angle side.

With the electromagnetic switching valve 45, an internal spool valve is arranged so as to control relative switching between the respective oil pressure passages 41 and 42, and the supply passage 43 and first and second drain passages 44*a* and 44*b*. The switching operation is effected by a control signal from a controller 48.

Figure 3:
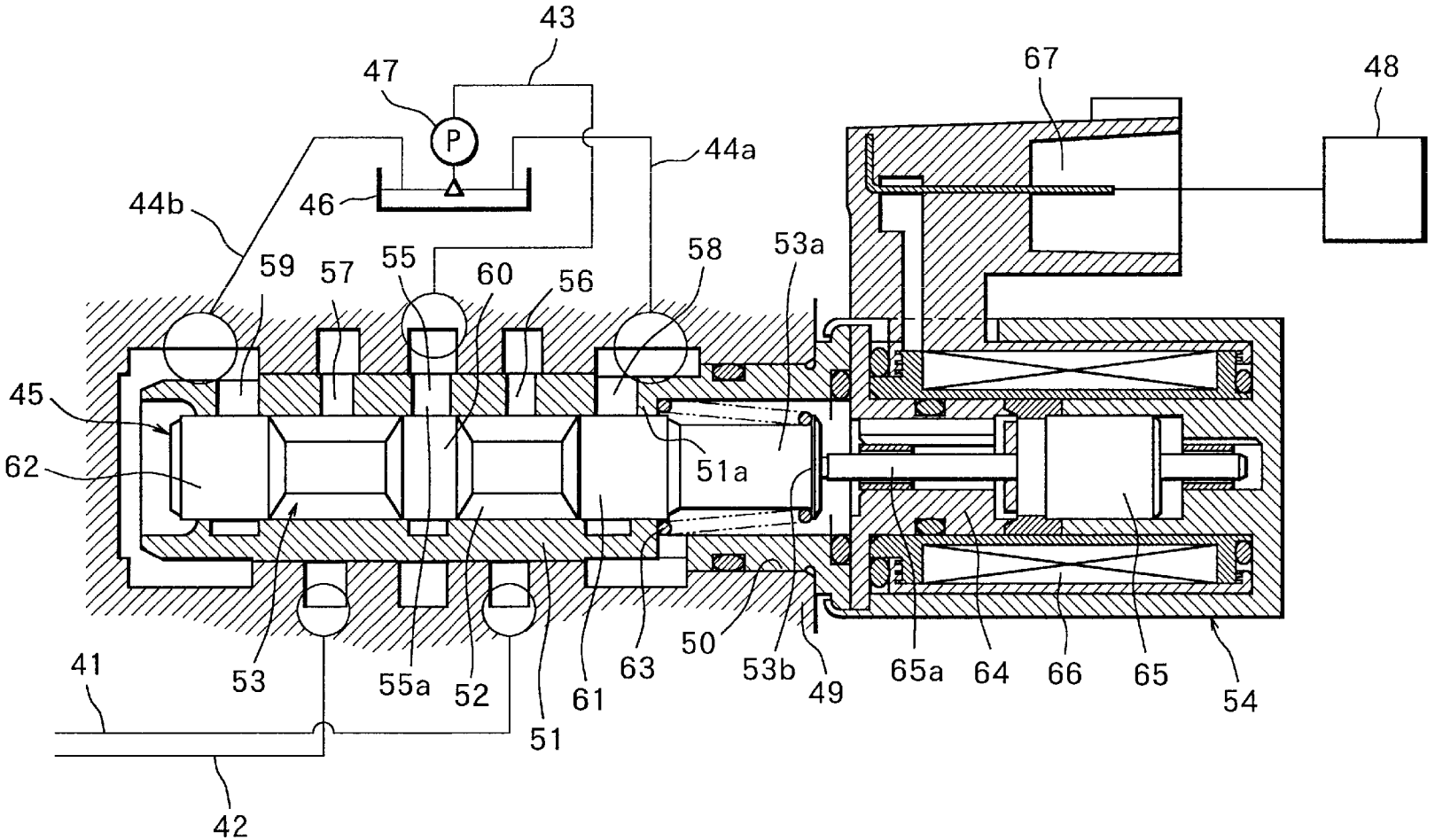
FIG. 3 is a longitudinal section showing an electromagnetic switching valve in the vane type variable valve timing control apparatus.

More specifically, as shown in FIG. 3, the electromagnetic switching valve 45 comprises a cylindrical valve body 51 insertingly secured inside a retaining bore 50 of a cylinder block 49, a spool valve 53 slidably provided inside a valve bore 52 in the valve body 51 for switching the flow passages, and a proportional solenoid type electromagnetic actuator 54 for actuating the spool valve 53.

With the valve body 51, a supply port 55 is formed in a substantially central position of the peripheral wall, for communicating a downstream side end of the supply passage 43 with the valve bore 52, and a first port 56 and a second port 57 are respectively formed in opposite sides of the supply port 55, for communicating the other end portions of the first and second oil pressure passages 41 and 42 with the valve bore 52.

Moreover, a third and fourth port 58 and 59 are formed in the opposite end portions of the peripheral wall, for communicating the two drain passages 44*a* and 44*b* with the valve bore 52.

The spool valve 53 has a substantially columnar shape first valve portion 60 on a central portion of a small diameter axial portion, for opening and closing the supply port 55, and has substantially columnar shape second and third valve portions 61 and 62 on opposite end portions, for opening and closing the third and fourth ports 58 and 59.

Furthermore, the spool valve 53 is urged to the right in the figure, that is, in a direction such that the supply port 55 and the second oil pressure passage 42 are communicated by the first valve portion 60, by means of a conical shape valve spring 63 resiliently provided between an umbrella-shaped portion 53*b* on a rim of a front end spindle 53*a*, and a spring seat 51*a* on a front end inner peripheral wall of the valve bore 52.

The electromagnetic actuator 54 is provided with a core 64, a moving plunger 65, a coil 66, and a connector 67. A drive rod 65*a* is secured to a tip end of the moving plunger 65 for pressing against the umbrella-shaped portion 53*b* of the spool valve 53.

The controller 48 detects the current operating conditions (engine load, engine rotation speed) by means of signals from a rotation sensor 101 for detecting engine rotation speed and an air flow meter 102 for detecting intake air quantity, and detects the relative rotation position of the cam sprocket 1 and the cam shaft, that is to say, the rotation phase of the cam shaft with respect to the crank shaft, by means of signals from a crank angle sensor 103 and a cam sensor 104.

The controller 48 controls the energizing quantity for the electromagnetic actuator 54 based on a duty control signal superimposed with a dither signal.

For example, when a control signal of duty ratio 0% (off signal) is output from the controller 48 to the electromagnetic actuator 54, the spool valve 53 moves towards the maximum right direction in the figure, under the spring force of the valve spring 63. As a result, the first valve portion 60 opens an opening end 55*a* of the supply port 55 to communicate with the second port 57, and at the same time the second valve portion 61 opens an opening end of the third port 58, and the third valve portion 62 closes the fourth port 59.

Therefore, the hydraulic fluid pumped from the oil pump 47 is supplied to the delay angle side hydraulic chambers 33 via the supply port 55, the valve bore 52, the second port 57, and the second oil pressure passage 42, and the hydraulic fluid inside the advance angle side hydraulic chambers 32 is discharged to inside the oil pan 46 from the first drain passage 44*a* via the first oil pressure passage 41, the first port 56, the valve bore 52, and the third port 58.

Consequently, the pressure inside the delay angle side hydraulic chambers 33 becomes a high pressure while the pressure inside the advance angle side hydraulic chambers 32 becomes a low pressure, and the rotation member 3 is rotated to the full to the delay angle side by means of the vanes 28*a* to 28*d*. The result of this is that the opening timing for the intake valves is delayed, and the overlap with the exhaust valves is thus reduced.

On the other hand, when a control signal of a duty ratio 100% (on signal) is output from the controller 48 to the electromagnetic actuator 54, the spool valve 53 slides fully to the left in the figure, against the spring force of the valve spring 63. As a result, the second valve portion 61 closes the third port 58 and at the same time the third valve portion 62 opens the fourth port 59, and the first valve portion 60 allows communication between the supply port 55 and the first port 56.

Therefore, the hydraulic fluid is supplied to inside the advance angle side hydraulic chambers 32 via the supply port 55, the first port 56, and the first oil pressure passage 41, and the hydraulic fluid inside the delay angle side hydraulic chambers 33 is discharged to the oil pan 46 via the second oil pressure passage 42, the second port 57, the fourth port 59, and the second drain passage 44*b*, so that the delay angle side hydraulic chambers 33 become a low pressure.

Therefore, the rotation member 3 is rotated to the full to the advance angle side by means of the vanes 28*a* to 28*d*. Due to this, the opening timing for the intake valve is advanced (advance angle) and the overlap with the exhaust valve is thus increased.

When a control signal having a duty ratio of 50% is output from the controller 48 to the electromagnetic actuator 54, the spool valve 53 takes a position (neutral position) where the first valve portion 60 closes the supply port 55, the second valve portion 61 closes the third port 58, and the third valve portion 62 closes the fourth port 59.

Moreover, the controller 48 sets by proportional, integral and derivative control action, a feedback correction amount PIDDTY for making a relative rotation position (rotation phase) of the cam sprocket 1 and the cam shaft 2 detected based on a signal from the crank angle sensor 103 and the cam sensor 104, coincide with a target value (target advance angle value) for the relative rotation position (rotation phase) set corresponding to the operating conditions. The controller 48 then makes the result of adding a predetermined base duty ratio BASEDTY (neutral control value) to the feedback correction amount PIDDTY a final duty ratio VTCDTY, and superimposes a dither signal on the control signal for the duty ratio VTCDTY and outputs this to the electromagnetic actuator 54.

The function of detecting the rotation phase based on a signal from the crank angle sensor 103 and the cam sensor 104 corresponds to a rotation phase detection means.

In the case where it is necessary to change the relative rotation position (rotation phase) in the delay angle direction, the duty ratio is reduced by means of the feedback correction amount PIDDTY, so that the hydraulic fluid pumped from the oil pump 47 is supplied to the delay angle side hydraulic chambers 33, and at the same time the hydraulic fluid inside the advance angle side hydraulic chambers 32 is discharged to inside the oil pan 46. Conversely, in the case where it is necessary to change the relative rotation position (rotation phase) in the advance angle direction, the duty ratio is increased by means of the feedback correction amount PIDDTY, so that the hydraulic fluid is supplied to inside the advance angle side hydraulic chambers 32, and at the same time the hydraulic fluid inside the delay angle side hydraulic chambers 33 is discharged to the oil pan 46.

Furthermore, in the case where the relative rotation position (rotation phase) is maintained in the current condition, the absolute value of the feedback correction amount PIDDTY decreases to thereby control so as to return to a duty ratio close to the base duty ratio.

Figure 4:
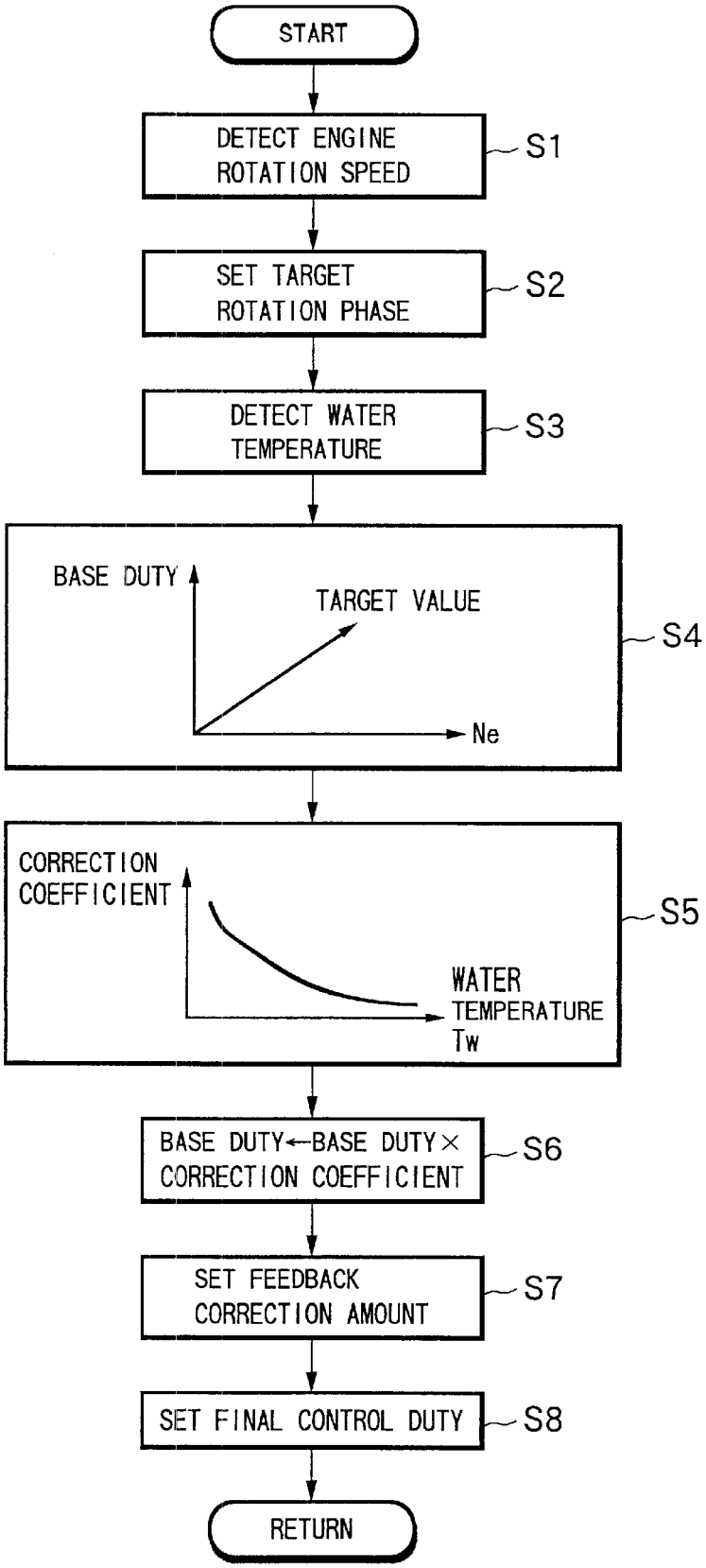
FIG. 4 is a flow chart showing a control function of the electromagnetic switching valve in the vane type variable valve timing control apparatus.

The valve timing control by means of the controller 48, will now be described in accordance with a flow chart in FIG. 4.

In step S1, the engine rotation speed Ne is calculated based on a detection signal from the rotation sensor 101.

In step S2, a target value of the rotation phase is set according to, for example, the engine load or the engine rotation speed Ne.

The part of this step S2 corresponds to the target value calculation means.

In step S3, the cooling water temperature Tw of the engine is detected based on a detection signal from a water temperature sensor 105.

In step S4, a base duty ratio BASEDTY corresponding to the target value and the engine rotation speed Ne at that time is retrieved from a map in which is pre-stored the base duty ratio BASEDTY (neutral control value) in accordance with the target value and the engine rotation speed Ne.

The part of this step S4 corresponds to the neutral control value calculation means.

Since the urging force of the spiral spring 36 varies due to the rotation phase, then when the valve is driven about the valve position corresponding to the neutral control value, using a constant neutral control value regardless of the rotation phase, the rotation phase is shifted toward the delay angle side or the advance angle side, depending on whether the neutral control value is higher or lower than a suitable urging force. Therefore, by setting the base duty ratio BASEDTY according to the target value, supply and discharge of the oil to each hydraulic chamber are performed at a balance corresponding to the urging force of the spiral spring 36 to thereby suppress the occurrence of steady-state deviation.

Moreover, with the switching of the base duty ratio BASEDTY in accordance with the engine rotation speed Ne, the oil pressure is estimated from the engine rotation speed Ne, and the switching of the base duty ratio BASEDTY is performed corresponding to the oil pressure.

As mentioned before, since the oil pump 47 is driven by the engine, and the pump rotation speed is proportional to the engine rotation speed Ne, the oil pressure can be estimated from the engine rotation speed Ne. On the other hand, since the base duty ratio BASEDTY required for retaining the rotation phase varies depending on the oil pressure, the base duty ratio BASEDTY is changed corresponding to the engine rotation speed Ne.

However, the construction may include an oil pressure sensor for directly detecting the oil pressure, or for the simplicity, the above described switching of the base duty ratio BASEDTY in accordance with the oil pressure (engine rotation speed Ne) may be omitted.

In step S5, a correction coefficient for correcting and setting the base duty ratio BASEDTY is set corresponding to the cooling water temperature Tw, based on the cooling water temperature Tw of the engine detected by the water temperature sensor 105.

The correction coefficient is set to a larger value with a decrease of the water temperature Tw, so that the base duty ratio BASEDTY is increasingly corrected with a decrease of the water temperature Tw.

The water temperature Tw is used as a temperature representative of the temperature of the hydraulic fluid. As a result, the base duty ratio BASEDTY can be corrected and set corresponding to the requirement of the base duty ratio BASEDTY which differs according to the temperature (viscosity) of the hydraulic fluid.

Accordingly, the water temperature sensor 105 corresponds to the oil temperature detecting means, and the part of this step S5 corresponds to the correction coefficient calculation means.

In step S6, the base duty ratio BASEDTY is corrected with the correction coefficient, to thereby determine the final base duty ratio BASEDTY.

The part of this step S6 corresponds to the correction means.

In step S7, the feedback correction amount PIDDTY is set by PID control based on the target value and the actual rotation phase.

The part of this step S7 corresponds to the feedback correction value calculation means.

Then, in step S8, the feedback correction amount PIDDTY is added to the base duty ratio BASEDTY to thereby determine the final duty ratio. A dither signal is then superimposed on a control signal for the determined duty ratio and the obtained signal is output to the electromagnetic actuator 54.

The part of this step S8 corresponds to the valve control means.

Here, the above construction is described as being for controlling the valve timing of the intake valve, but the construction may be for controlling the valve timing of the exhaust valve. In this case, the construction may be such that when a control signal having a duty ratio of 100% (on signal) is output to the electromagnetic actuator 54, the timing is controlled so as to be delayed (the overlap quantity is maximum), and when a control signal having a duty ratio of 0% (off signal) is output to the electromagnetic actuator 54, the timing is controlled so as to be advanced (the overlap quantity is minimum). Moreover, the vanes (rotation body 3) may be urged to the advance angle side by the spiral spring 36.

What we claimed are:

1. A vane type variable valve timing control apparatus comprising:

a vane secured to a cam shaft;

a housing provided integral with a cam sprocket, and housing said vane so as to be relatively rotatable thereto to thereby form an advance angle side hydraulic chamber and a delay angle side hydraulic chamber on rotation direction front and rear sides of said vane, a spool valve for stopping supply and discharge of oil with respect to said both hydraulic chambers in a neutral position, and switching hydraulic chambers for which oil supply and discharge is being performed depending on a movement direction from said neutral position, so that when oil is being supplied to one hydraulic chamber oil is discharged from the other hydraulic chamber;

a resilient body for urging said vane to either one of an advance angle side and a delay angle side;

target value calculation means for calculating a target value of a rotation phase of said cam shaft to said cam sprocket;

neutral control value calculation means for calculating a neutral control value of said spool valve corresponding to said target value;

rotation phase detection means for detecting a rotation phase of said cam shaft to said cam sprocket;

feedback correction value calculation means for calculating a feedback correction value based on the rotation phase detected by said rotation phase detection means and said target value; and valve control means for controlling said spool valve based on said neutral control value and said feedback correction value.

2. A vane type variable valve timing control apparatus according to claim 1, wherein there is provided:

oil temperature detecting means for detecting a temperature of said oil;

correction coefficient calculation means for calculating a correction coefficient for correcting said neutral control value, based on the oil temperature detected by said oil temperature detection means; and correction means for correcting said neutral control value with said correction coefficient.

3. A vane type variable valve timing control apparatus comprising:

a vane secured to a cam shaft;

a housing provided integral with a cam sprocket, and housing said vane so as to be relatively rotatable thereto to thereby form an advance angle side hydraulic chamber and a delay angle side hydraulic chamber on rotation direction front and rear sides of said vane, a spool valve for stopping supply and discharge of oil with respect to said both hydraulic chambers in a neutral position, and switching hydraulic chambers for which oil supply and discharge is being performed depending on a movement direction from said neutral position, so that when oil is being supplied to one hydraulic chamber oil is discharged from the other hydraulic chamber;

a resilient body for urging said vane to either one of an advance angle side and a delay angle side;

target value calculation means for calculating a target value of a rotation phase of said cam shaft to said cam sprocket;

neutral control value calculation means for calculating a neutral control value of said spool valve based on said target value and a pressure of oil supplied to said spool valve;

rotation phase detection means for detecting a rotation phase of said cam shaft to said cam sprocket;

feedback correction value calculation means for calculating a feedback correction value based on the rotation phase detected by said rotation phase detection means and said target value; and valve control means for controlling said spool valve based on said neutral control value and said feedback correction value.

4. A vane type variable valve timing control apparatus comprising:

a vane secured to a cam shaft;

a housing provided integral with a cam sprocket, and housing said vane so as to be relatively rotatable thereto to thereby form an advance angle side hydraulic chamber and a delay angle side hydraulic chamber on rotation direction front and rear sides of said vane, a spool valve for stopping supply and discharge of oil with respect to said both hydraulic chambers in a neutral position, and switching hydraulic chambers for which oil supply and discharge is being performed depending on a movement direction from said neutral position, so that when oil is being supplied to one hydraulic chamber oil is discharged from the other hydraulic chamber, a spiral spring for urging said vane to a delay angle side;

an oil pump driven by an engine, for supplying oil to said spool valve;

target value calculation means for calculating a target value of a rotation phase of said cam shaft to said cam sprocket;

neutral control value calculation means for calculating a neutral control value of said spool valve in accordance with said target value and a rotation speed of said engine;

correction coefficient calculation means for calculating a correction coefficient for correcting said neutral control value, based on cooling water temperature of said engine;

correction means for correcting said neutral control value with said correction coefficient;

rotation phase detection means for detecting a rotation phase of said cam shaft to said cam sprocket;

feedback correction value calculation means for calculating a feedback correction value based on the rotation phase detected by said rotation phase detection means and said target value; and valve control means for controlling said spool valve based on the neutral control value corrected by said correction means and said feedback correction value.

5. A vane type variable valve timing control apparatus comprising:

a vane secured to a cam shaft;

a housing provided integral with a cam sprocket, and housing said vane so as to be relatively rotatable thereto to thereby form an advance angle side hydraulic chamber and a delay angle side hydraulic chamber on rotation direction front and rear sides of said vane, a spool valve for stopping supply and discharge of oil with respect to said both hydraulic chambers in a neutral position, and switching hydraulic chambers for which oil supply and discharge is being performed depending on a movement direction from said neutral position, so that when oil is being supplied to one hydraulic chamber oil is discharged from the other hydraulic chamber; and a resilient body for urging said vane to either one of an advance angle side and a delay angle side; wherein by controlling said spool valve, the relative position of said vane is changed with respect to said housing, and a rotation phase of said cam shaft to said cam sprocket is controlled to a target value, and at the time of retaining the rotation phase of said cam shaft to said cam sprocket, said spool valve is driven referenced to a position corresponding to the target value of said rotation phase.

6. A method of controlling a vane type variable valve timing control apparatus which comprises:

a vane secured to a cam shaft;

a housing provided integral with a cam sprocket, and housing said vane so as to be relatively rotatable thereto to thereby form an advance angle side hydraulic chamber and a delay angle side hydraulic chamber on rotation direction front and rear sides of said vane, a spool valve for stopping supply and discharge of oil with respect to said both hydraulic chambers in a neutral position, and switching hydraulic chambers for which oil supply and discharge is being performed depending on a movement direction from said neutral position, so that when oil is being supplied to one hydraulic chamber oil is discharged from the other hydraulic chamber; and a resilient body for urging said vane to either one of an advance angle side and a delay angle side; said method comprising the steps of:

calculating a target value of a rotation phase of said cam shaft to said cam sprocket;

calculating a neutral control value of said spool valve corresponding to said target value;

detecting a rotation phase of said cam shaft to said cam sprocket;

calculating a feedback correction value based on said detected rotation phase and said target value; and controlling said spool valve based on said neutral control value and said feedback correction value.

7. A method of controlling a vane type variable valve timing control apparatus according to claim 6, wherein said step for calculating said neutral control value calculates said neutral control value based on said target rotation phase and a pressure of oil supplied to said spool valve.

8. A method of controlling a vane type variable valve timing control apparatus according to claim 6, wherein an oil pump for supplying oil to said spool valve is driven by an engine, and said step for calculating said neutral control value calculates said neutral control value based on said target rotation phase and a rotation speed of said engine.

9. A method of controlling a vane type variable valve timing control apparatus according to claim 6, further comprising the steps of;

detecting a temperature of said oil;

calculating a correction coefficient for correcting said neutral control value, based on the detected oil temperature; and correcting said neutral control value with said correction coefficient.

* * * * *

UNITED STATES PATENT AND TRADEMARK OFFICE

CERTIFICATE OF CORRECTION

PATENT NO. : 6,338,323 B1
DATED : January 15, 2002
INVENTOR(S) : Kenichi Machida It is certified that error appears in the above-identified patent and that said Letters Patent is hereby corrected as shown below:

Title page,
Item [30], please change the Foreign Applications Priority No. from "11-276897" to -- 11-273987 --

Signed and Sealed this

Twenty-second Day of April, 2003

JAMES E. ROGAN
*Director of the United States Patent and Trademark Office*